US009915465B2

(12) United States Patent
Matsunaga et al.

(10) Patent No.: US 9,915,465 B2
(45) Date of Patent: Mar. 13, 2018

(54) HEAT PUMP COMPRESSOR INCLUDING LIQUID CRYSTAL POLYMER INSULATING MATERIAL

(71) Applicant: Mitsubishi Electric Corporation, Tokyo (JP)

(72) Inventors: Noriaki Matsunaga, Tokyo (JP); Shinobu Ogasawara, Tokyo (JP); Takeharu Kageyama, Tokyo (JP); Satoru Toyama, Tokyo (JP); Kota Mizuno, Tokyo (JP); Yutaka Hirakawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/300,306

(22) PCT Filed: Mar. 6, 2015

(86) PCT No.: PCT/JP2015/056704

§ 371 (c)(1),
(2) Date: Sep. 29, 2016

(87) PCT Pub. No.: WO2015/156064

PCT Pub. Date: Oct. 15, 2015

(65) Prior Publication Data

US 2017/0146284 A1 May 25, 2017

(30) Foreign Application Priority Data

Apr. 10, 2014 (JP) ..... 2014-081125

(51) Int. Cl.
*F25D 23/00* (2006.01)
*F25D 23/06* (2006.01)
(Continued)

(52) U.S. Cl.
CPC ..... *F25D 23/065* (2013.01); *F04C 18/356* (2013.01); *F04C 29/0085* (2013.01);
(Continued)

(58) Field of Classification Search
CPC .... F25D 23/065; F25D 23/08; F25D 2201/10; F25B 31/02; F25B 13/00; F04C 18/356; F04C 29/0085; F04C 29/02; F04C 2210/263; F04C 2240/30; F04C 2240/40
See application file for complete search history.

(56) References Cited

U.S. PATENT DOCUMENTS 5,531,080 A 7/1996 Hirahara et al.
6,054,064 A 4/2000 D'Aubarede et al.
(Continued)

FOREIGN PATENT DOCUMENTS

JP H07-208819 A 8/1995
JP H08-509020 A 9/1996
(Continued)

OTHER PUBLICATIONS

International Search Report of the International Searching Authority dated May 19, 2015 for the corresponding international application No. PCT/JP2015/056704 (and English translation).
(Continued)

*Primary Examiner* — Cassey D Bauer
(74) *Attorney, Agent, or Firm* — Posz Law Group, PLC

(57) ABSTRACT

An insulating material that tends not to hydrolyze is used to thereby provide a heat pump apparatus having long-term reliability. An electric motor of a compressor is fixed to a sealed container and includes a stator around which a winding wire is wound through intermediation of an insulating material, and a rotor surrounded by the stator. The insulating material is a wholly aromatic liquid crystal polyester (LCP) having a molecular main chain constituted by a monomer including p-hydroxybenzoic acid (PHB) as an essential monomer and a monomer solely including benzene-ring as another monomer via an ester bond. The refrigerating machine oil has a saturated water content of 2% or less at 40 degrees C., a relative humidity of 80%, for 24 Hr. To suppress the explosive decomposition reaction of
(Continued)

ethylene-based fluorohydrocarbon, a flame retardant is used to generate chemical species that complement active radicals that cause the decomposition reaction.

15 Claims, 3 Drawing Sheets

(51) Int. Cl.

| | |
|---|---|
| ***F04C 18/356*** | (2006.01) |
| ***F04C 29/00*** | (2006.01) |
| ***F04C 29/02*** | (2006.01) |
| ***F25B 13/00*** | (2006.01) |
| ***F25B 31/02*** | (2006.01) |
| ***F25D 23/08*** | (2006.01) |

(52) U.S. Cl.

CPC ..... *F04C 29/02* (2013.01); *F25B 13/00* (2013.01); *F25B 31/02* (2013.01); *F25D 23/08* (2013.01); *F04C 2210/263* (2013.01); *F04C 2240/30* (2013.01); *F04C 2240/40* (2013.01); *F25D 2201/10* (2013.01)

(56) References Cited

U.S. PATENT DOCUMENTS

| | | | | |
|---|---|---|---|---|
| 2005/0242323 | A1 | 11/2005 | Leck et al. | |
| 2013/0057120 | A1* | 3/2013 | Takasu ..... | F04B 35/04 310/68 C |
| 2014/0077123 | A1 | 3/2014 | Fukushima | |
| 2015/0076393 | A1 | 3/2015 | Saito et al. | |

FOREIGN PATENT DOCUMENTS

| | | | |
|---|---|---|---|
| JP | H10-159730 | A | 6/1998 |
| JP | H10-506131 | A | 6/1998 |
| JP | H11-246447 | A | 9/1999 |
| JP | 2000-324728 | A | 11/2000 |
| JP | 2000-344879 | A | 12/2000 |
| JP | 2001-227827 | A | 8/2001 |
| JP | 2002-249647 | A | 9/2002 |
| JP | 2003-139423 | A | 5/2003 |
| JP | 2003-313403 | A | 11/2003 |
| JP | 2004-052730 | A | 2/2004 |
| JP | 2004-208446 | A | 7/2004 |
| JP | 3801132 | B2 | 7/2006 |
| JP | 2007-511644 | A | 5/2007 |
| JP | 2008-215748 | A | 9/2008 |
| JP | 2009-299649 | A | 12/2009 |
| WO | 2012/157764 | A1 | 11/2012 |
| WO | 2012/157765 | A1 | 11/2012 |
| WO | 2013/147048 | A1 | 10/2013 |

OTHER PUBLICATIONS

Office Action dated Aug. 23, 2016 issued in corresponding JP patent application No. 2014-081125 (English translation only).

The Extended European Search Report dated Nov. 13, 2017 in corresponding EP application No. 15776954.8.

Japanese Office Action dated Dec. 19, 2017 in corresponding JP application No. 2017-039646 (English translation attached).

* cited by examiner

HEAT PUMP COMPRESSOR INCLUDING LIQUID CRYSTAL POLYMER INSULATING MATERIAL

This application is a U.S. national stage application of PCT/JP2015/056704 filed on Mar. 6, 2015, which claims priority to Japanese Patent Application No. 2014-081125 filed on Apr. 10, 2014, the contents of which are incorporated herein by reference.

TECHNICAL FIELD

The present invention relates to a heat pump apparatus, in particular, to a heat pump apparatus that includes a compressor including a sealed container housing an electric motor and constitutes a refrigeration cycle.

BACKGROUND

There is conventionally a heat pump apparatus in which a compressor that compresses refrigerant, a condenser, an expansion mechanism, and an evaporator are sequentially connected to perform a refrigeration cycle, and, in the condenser or the evaporator, the heating energy or cooling energy of the refrigerant is transferred (heat-transferred) to heat medium.

The compressor includes a compression mechanism and an electric motor that rotatively drives the compression mechanism. The compression mechanism and the electric motor are housed in a sealed container. The high-pressure and high-temperature refrigerant compressed by the compression mechanism is once discharged into the sealed container. Thus, the electric motor is exposed to such high-pressure and high-temperature refrigerant. To smoothly rotate the compression mechanism, a machine oil (hereafter referred to as "refrigerating machine oil") is stored in the sealed container.

The electric motor includes a stator fixed to the sealed container and a rotor that is surrounded by the stator and rotates. The rotor is coupled to the compression mechanism. The stator has a cylindrical shape and includes a back yoke part forming an outer periphery of the stator, plural teeth parts protruding from the back yoke part toward the center, and a winding wire (electric wire) wound around the teeth parts through intermediation of an insulating material (insulator).

In addition, as the insulating material (insulator), there is disclosed an invention using polyphenylene sulfide (PPS), which does not have ester bonds (for example, refer to Patent Literature 1).

Further, as the insulating material (insulator), there is disclosed an invention using polyethylene terephthalate (PET) or polyethylene naphthalate (PEN), which have ester bonds (for example, refer to Patent Literature 2).

Regarding the refrigerant used for the heat pump apparatus, to prevent destruction of the ozone layer, chlorine-free refrigerants have come to be used as substitutes in recent years. However, there is a problem in that, such chlorine-free HFC refrigerants have a relatively high Global warming potential (GWP). Accordingly, measures to prevent the refrigerants from leaking outside the cycles have come to be taken, and recovery of the refrigerants at the time of disposal of the devices has become compulsory. However, a recovery ratio is not sufficient. Thus, use of a refrigerant that has an even lower GWP as a substitute is being considered.

As the refrigerant for stationary air-conditioning apparatus, R410A has been used. However, use of R32 refrigerant and other refrigerants having lower GWPs as substitutes is being considered.

In the EU, there is a movement toward mandatory use of refrigerants having even lower GWPs. The candidate refrigerants include natural refrigerants such as $CO_2$ and, for example, a hydro-olefin-based refrigerant that is HFO-1234yf, or a propylene-based fluorohydrocarbon.

However, hydro-olefin has a molecular structure having a carbon double bond. In general, such functional groups having a carbon (double bond) or triple bond, in other words, (unsaturated hydrocarbons) such as alkenes and alkynes, have a feature of undergoing addition reactions with various molecules. Thus, compared with conventional refrigerants not having double bonds, the double bonds of the hydrocarbons tend to cleave, that is, the functional groups tend to react with other substances and the chemical stability is very poor.

For this reason, the following method has been disclosed: the surface of a slidable section that has high temperature in a compressor and on which decomposition or polymerization of propylene-based fluorohydrocarbon, which is one of hydro-olefins, tends to occur, is constituted by a non-metal part, to thereby suppress decomposition or polymerization of the refrigerant (for example, refer to Patent Literature 3).

Tetrafluoroethylene is useful as a monomer for producing fluororesins and fluorine-containing elastomers having excellent properties in terms of, for example, heat resistance and chemical resistance. However, tetrafluoroethylene has a very high probability of polymerization. Accordingly, to suppress the polymerization, a polymerization inhibitor needs to be added at the time of generation of tetrafluoroethylene. This technique has been disclosed (for example, refer to Patent Literature 4).

PATENT LITERATURE

Patent Literature 1: Japanese Unexamined Patent Application Publication No. 2000-324728 (page 6, FIG. 2)

Patent Literature 2: Japanese Unexamined Patent Application Publication No. 2001-227827 (pages 3-4, FIG. 2)

Patent Literature 3: Japanese Unexamined Patent Application Publication No. 2009-299649

Patent Literature 4: Japanese Unexamined Patent Application Publication No. H11-246447

PPS, which does not have ester bonds and is described as an insulating material in Patent Literature 1, is a thermoplastic crystalline engineering plastic having a repeating unit of [-ph-S-] and obtained by reacting p-dichlorobenzene and alkali sulfide at high temperature and high pressure. PPS has characteristics of relatively high heat resistance, no risk of hydrolysis, satisfactory moldability, and high strength and high rigidity.

However, during melt-molding, since the solidification rate is low, there are the following problems: the productivity is low; burrs tend to be formed; and decomposition in a trace amount results in generation of sulfur gas, which corrodes the mold.

On the other hand, PET and PEN, which have ester bonds and are described as insulating materials in Patent Literature 2, and polybutylene terephthalate (PBT) are hydrolyzable. For this reason, a water-absorbable refrigerating machine oil needs to be used to absorb water in a refrigerant circuit while the oil is circulated through the refrigerant circuit. In addition, there is a problem in that, when the refrigerating machine oil has high hygroscopicity and contains a large amount of water, hydrolysis may be caused.

In particular, in the case of air-conditioning apparatus, during replacement of the product, the existing installed pipe connecting the outdoor unit and the indoor unit is continuously used. In this case, the refrigerating machine oil remaining and adhering to the inner wall of the pipe may absorb water or dew condensation may occur on the inner wall of the pipe due to exposure to the air, and this water may be absorbed by the refrigerating machine oil circulating the refrigeration cycle and may result in an increase in the water content ratio even to saturation of water content. There is a problem in that, such refrigerating machine oil brings water into the compressor and results in hydrolysis of the insulating material having ester bonds.

Compared with R410A, R32 has a low GWP, and the temperature of R32 increases, due to the thermal properties of the refrigerant, by about 10 to about 20 degrees C. at the discharge portion of the compressor, at which the refrigerant has the highest temperature and the highest pressure in the refrigeration cycle. Accordingly, when the refrigerating machine oil stored in the compressor has high water absorption rate, the increase in the temperature may accelerate hydrolysis of the insulating material having ester bonds.

Compared with conventional refrigerants not having double bonds, hydro-olefin-based refrigerants having even lower GWPs than R32 tend to cleave at the double bonds; in other words, the functional groups tend to react with other substances. Thus, the refrigerants have very poor chemical stability.

Accordingly, there is a problem in that, hydro-olefin-based refrigerants that are a propylene-based fluorohydrocarbon refrigerant and an ethylene-based fluorohydrocarbon refrigerant both generate refrigerant decomposition products, which chemically deteriorate the insulating materials of the electric motor for the compressor.

HFO-1234yf refrigerant, or a propylene-based fluorohydrocarbon, has a high standard boiling point of −29 degrees C. Compared with R410A refrigerant (standard boiling point: −51 degrees C.) and other refrigerants conventionally used for stationary air-conditioning apparatus, HFO-1234yf refrigerant has a low operation pressure and has a low refrigeration capacity per suction volume. In a stationary air-conditioning apparatus, when HFO-1234yf refrigerant is used to obtain a refrigeration capacity as in R410A refrigerant, the volumetric flow rate of the refrigerant needs to be increased. Thus, there are problems relating to an increase in the displacement of the compressor and problems of an increase in the pressure loss and a decrease in the efficiency due to the increase in the volumetric flow rate.

Thus, in application of a low-GWP refrigerant to stationary air-conditioning apparatus, a low-GWP refrigerant having a low standard boiling point is suitable. Typically, a refrigerant having fewer carbon atoms tends to have a lower boiling point. Accordingly, compared with a conventional propylene-based fluorohydrocarbon having three carbon atoms, an ethylene-based fluorohydrocarbon having two carbon atoms may be a compound, that is, a refrigerant, having a low boiling point.

However, the ethylene-based fluorohydrocarbon is even more reactive than the propylene-based fluorohydrocarbon, thermally and chemically unstable, and tends to undergo decomposition or polymerization. Accordingly, it is difficult to suppress the decomposition and polymerization only by the method described in Patent Literature 4.

When the ethylene-based fluorohydrocarbon is used as the refrigerant, the refrigerant tends to undergo decomposition or polymerization immediately after its generation, and also undergoes decomposition or polymerization even during storage. To suppress decomposition and polymerization of the refrigerant during storage, a polymerization inhibitor for suppressing polymerization of refrigerant described in Patent Literature 2 is added, at the time of generation of refrigerant, to the ethylene-based fluorohydrocarbon as refrigerant. However, even when a polymerization inhibitor is added to refrigerant, the refrigerant circulates through the refrigeration cycle while being repeatedly undergone phase changes between liquid and gas; the refrigerant thus vaporizes in high-temperature areas in the compressor that are a compressor slidable section and the winding wire portion of the motor, where polymerization tends to occur. Since the polymerization inhibitor is contained in the vaporized refrigerant and carried away, the polymerization inhibitor is not sufficiently supplied to the compressor slidable section or the winding wire portion of the motor, so that it has been difficult to sufficiently obtain the effect of preventing polymerization of refrigerant. Some ethylene-based fluorohydrocarbons undergo an explosive decomposition reaction initiated by, for example, heat generated by polymerization reaction, and the refrigeration cycle or the refrigerant compressor may thus be damaged.

SUMMARY

The present invention has been made to address the above-described problems. A first object is to use an insulating material that tends not to be hydrolyzed even in the case of using a refrigerating machine oil having high hygroscopicity and high water content in oil and even at a high discharge temperature of the compressor due to R32 refrigerant, to thereby obtain long-term reliability of a heat pump apparatus.

A second object is to use an insulating material having satisfactory productivity in which, during a production step of the insulating material such as melt-molding, burrs are not formed and sulfur-containing gas is not generated, to thereby obtain long-term reliability of the heat pump apparatus at low cost.

A third object is to use an insulating material resistant to decomposition products of refrigerant even in the case of using, as the refrigerant, propylene-based fluorohydrocarbon, ethylene-based fluorohydrocarbon, or a mixture of the foregoing that tend to decompose, to thereby obtain long-term reliability of the heat pump apparatus.

A fourth object is, in the case of using, as refrigerant, ethylene-based fluorohydrocarbon that tends to decompose or a mixture containing the ethylene-based fluorohydrocarbon, to suppress the decomposition reaction of refrigerant in the slidable section of the compression element, to thereby obtain long-term reliability of the heat pump apparatus.

A heat pump apparatus according to an aspect of the present invention includes a compressor; a condenser; an expansion mechanism; and an evaporator, the compressor, the condenser, the expansion mechanism, and the evaporator being configured to perform a refrigeration cycle, the heat pump apparatus being configured to perform in the condenser or the evaporator, in which the compressor includes a sealed container; a compression mechanism mounted inside the sealed container; and an electric motor configured to rotatively drive the compression mechanism, the compression mechanism being configured to compress a refrigerant and to be lubricated by a refrigerating machine oil, in which the electric motor includes a stator fixed to the sealed container with a winding wire being wound around the stator through intermediation of an insulating material; and a rotor surrounded by the stator, in which the insulating material is a wholly aromatic liquid crystal polyester (LCP) having a molecular main chain constituted by a monomer including p-hydroxybenzoic acid (PHB) as an essential monomer and a monomer solely including benzene-ring as another monomer via an ester bond; and the refrigerating machine oil has a saturated water content of 2% or less at 40 degrees C. and a relative humidity of 80%, for 24 Hr.

In a heat pump apparatus according to another aspect of the invention, the refrigerant used is a single- or multi-component substance composed of at least one of difluoromethane (HFC-32), propylene-based fluorohydrocarbon (HFO-1234yf), and ethylene-based hydrogen fluoride, or a multi-component substance containing a mixture of difluoromethane (HFC-32) and ethylene-based hydrogen fluoride, and the ratio of the ethylene-based hydrogen fluoride to R32 is 70 wt % or less.

The ethylene-based hydrogen fluoride may be any one of trans-1,2-difluoroethylene (R1132(E)), fluoroethylene (R1141), cis-1,2-difluoroethylene (R1132(Z)), 1,1-difluoroethylene (R1132a), and 1,1,2-trifluoroethylene (R1123), or one or more of the foregoing may be mixed.

The heat pump apparatus employs the above-described refrigerant and includes a compression element configured to compress the refrigerant, a slidable part disposed in the compression element and constituting a slidable section, and refrigerating machine oil configured to be supplied to the slidable part to lubricate the slidable section.

Regarding the explosive decomposition reaction of ethylene-based fluorohydrocarbon, for example, 1,1,2-trifluoroethylene (R1123) may undergo disproportionation reaction of $CF_2{=}CHF$ (g)→1/2$CF_4$ (g)+3/2C (amorphous)+HF+44.7 kcal/mol, initiated with a stimulus such as generated heat. This reaction in which such self reactions occur consecutively with, for example, generated heat, explosively proceeds.

To suppress this reaction, another refrigerant that does not undergo self reaction may be mixed in a certain proportion; and use of refrigerants having similar standard boiling points enables near-azeotropy, which is advantageous. Trans-1,2-difluoroethylene (R1132(E)), an ethylene-based hydrogen fluoride, and R32 both have a standard boiling point of about −51 degrees C. and near-azeotropy is achieved; thus, they are advantageously mixed.

A heat pump apparatus according to still another aspect of the invention employs a refrigerant that is a single- or multi-component substance composed of at least one of propylene-based fluorohydrocarbon (HFO-1234yf) and ethylene-based hydrogen fluoride, or a multi-component substance containing a mixture of difluoromethane (HFC-32) and ethylene-based hydrogen fluoride, in which the ratio of the ethylene-based hydrogen fluoride to R32 is 70 wt % or less; and includes a compression element configured to compress the refrigerant, a slidable part disposed in the compression element and constituting a slidable section, and a refrigerating machine oil configured to be supplied to the slidable part to lubricate the slidable section, in which the refrigerant and the refrigerating machine oil contain a flame retardant that suppresses the decomposition reaction of the refrigerant.

The mechanism of action of a halogen-based flame retardant in a normal combustion reaction is as follows. Decomposition of the flame retardant at high temperature results in generation of halogen atoms. The halogen atoms abstract hydrogen atoms from, for example, hydrocarbon to generate hydrogen halide. The hydrogen halide reacts with active radicals in the combustion gas to deactivate the active radicals. Concurrently, halogen atoms are generated again and these regenerated halogen atoms further deactivate active radicals. In this way, the catalytic mechanism using generation of halogen atoms as key enables effective suppression of the combustion reaction. In this mechanism of action, hydrogen fluoride has high covalency and hence exerts a weak effect of deactivating active radicals.

Also, a phosphorus-based flame retardant decomposes within a combustion gas to generate radical species and the radical species deactivates active radicals, to thereby exert the effect similar to that of the halogen-based flame retardant.

The explosive decomposition reaction of ethylene-based fluorohydrocarbon is also initiated by active radicals generated by, for example, generated heat. For example, 1,1,2-trifluoroethylene (R1123) may undergo disproportionation reaction described above, initiated with a stimulus such as generated heat. This reaction in which active radicals generated by, for example, generated heat, react with R1123 molecules to cause consecutive generations of active radicals, explosively proceeds. Accordingly, by making the refrigerating machine oil contain a flame retardant, hydrogen halide that deactivates active radicals is generated from the flame retardant at high temperature, to thereby effectively suppress the explosive decomposition reaction.

Addition of an antimony compound can enhance the effect of a halogen-based flame retardant. Although an antimony compound alone does not substantially exert flame retardancy, an antimony compound reacts with a halogen-based flame retardant in a stepwise manner to generate antimony halide; and the antimony halide functions as a radical trap, to thereby exert flame retardancy.

In addition to the refrigerating machine oil, the slidable part of the compression element and the insulating material may also be made to contain a flame retardant that suppresses the decomposition reaction of the refrigerant.

According to the first aspect of the present invention, the insulating material of an electric motor is a wholly aromatic liquid crystal polyester (LCP) having a molecular main chain constituted by a monomer including p-hydroxybenzoic acid (PHB) as an essential monomer and a monomer solely including benzene-ring as another monomer via an ester bond. Thus, in the case of using a refrigerating machine oil having a very low water absorption rate of 0.01% and a saturated water content in oil of 2% or less at 40 degrees C. and a relative humidity of 80%, for 24 Hr, deterioration of the insulating function due to hydrolysis tends not to occur. Thus, a heat pump apparatus excellent in long-term reliability can be provided. This advantage does not depend on a kind of refrigerants; however, in particular, when R32 refrigerant is used, the discharge portion of the compressor has increased temperature and hence the advantage is more effectively given.

In a heat pump apparatus according to the second aspect of the invention, the insulating material is a wholly aromatic liquid crystal polyester (LCP) having a molecular main chain constituted by a monomer including p-hydroxybenzoic acid (PHB) as an essential monomer and a monomer solely including benzene-ring as another monomer via an ester bond. As a result, even when a refrigerant containing propylene-based fluorohydrocarbon or ethylene-based fluorocarbon is used, decomposition products of the refrigerant tend not to deteriorate the insulating material. Thus, a heat pump apparatus excellent in long-term reliability can be provided.

A heat pump apparatus according to the third aspect of the invention employs, as the refrigerant, a mixture containing R32 and ethylene-based fluorocarbon in which the ratio of the ethylene-based fluorohydrocarbon to R32 is 70 wt % or less. This enables suppression of the decomposition reaction of the refrigerant in the slidable section of the compression element.

A heat pump apparatus according to the fourth aspect of the invention employs, as the refrigerant, ethylene-based fluorohydrocarbon or a mixture containing ethylene-based fluorohydrocarbon, and includes a compression element configured to compress the refrigerant, a slidable part disposed in the compression element and constituting a slidable section, and a refrigerating machine oil configured to be supplied to the slidable part to lubricate the slidable section; and the refrigerant and also the refrigerating machine oil, the slidable part of the compression element, or the insulating material are made to contain a flame retardant that suppresses the decomposition reaction of the refrigerant. This enables suppression of the decomposition reaction of the refrigerant in the slidable section of the compression element.

DETAILED DESCRIPTION

Embodiment 1

Figure 1:
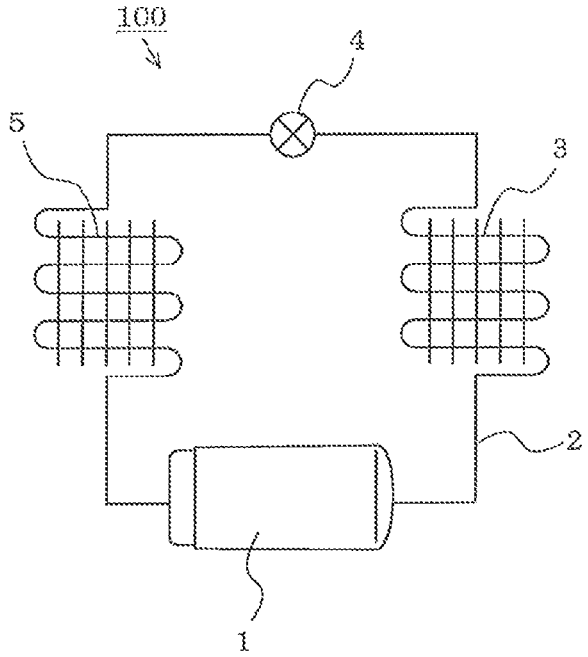
FIG. 1 is a refrigerant circuit diagram illustrating the basic configuration of a heat pump apparatus according to Embodiment 1 of the present invention.
Figure 2:
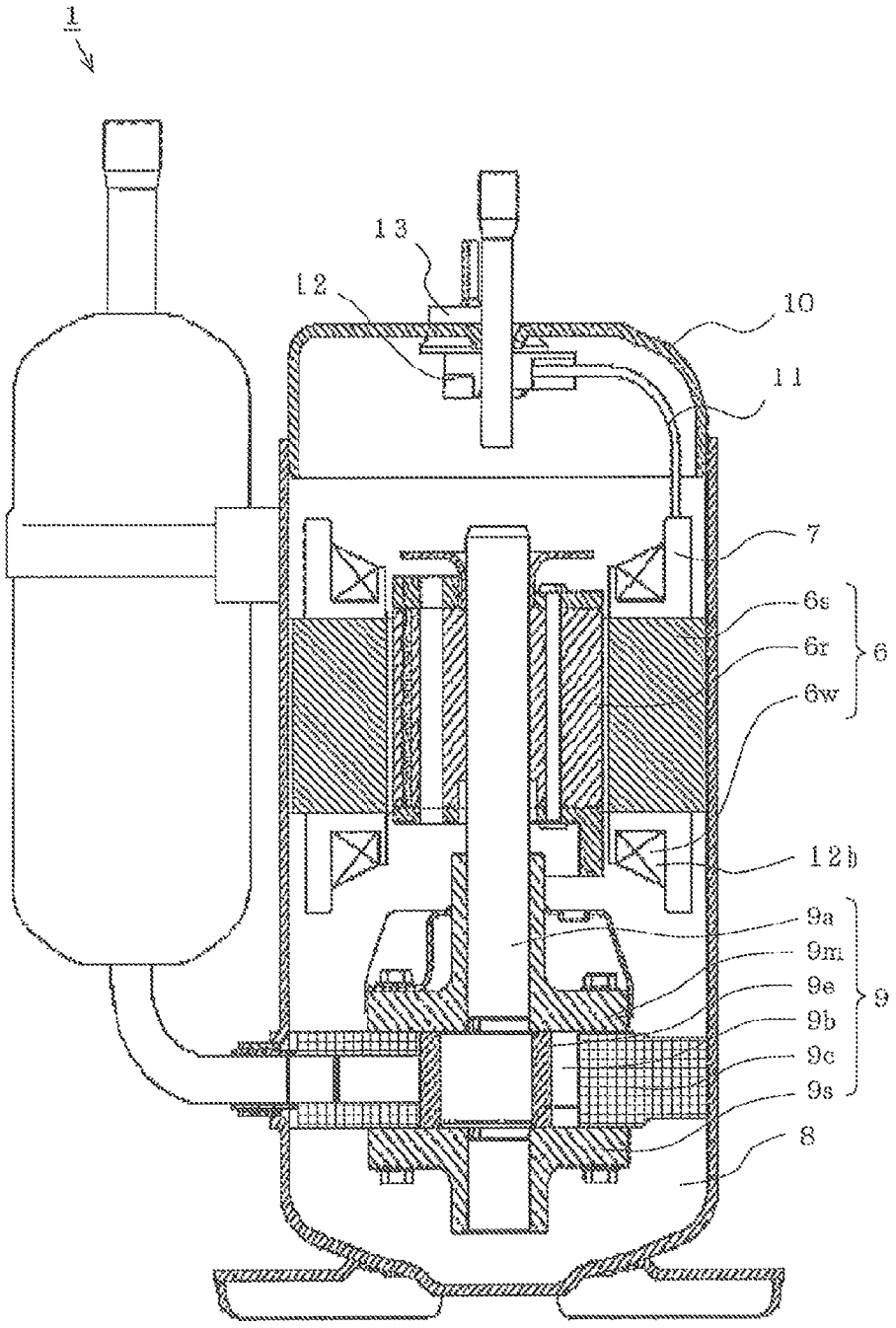
FIG. 2 is a sectional side view of a part (compressor) of the heat pump apparatus illustrated in FIG. 1.

FIG. 1 and FIG. 2 illustrate a heat pump apparatus according to Embodiment 1 of the present invention. FIG. 1 is a refrigerant circuit diagram illustrating the basic configuration. FIG. 2 is a sectional side view of a part (compressor). Note that, the drawings are schematically illustrated and the present invention is not limited to the illustrated forms.

(Refrigerant Circuit)

In FIG. 1, a heat pump apparatus 100 includes a compressor 1 configured to compress refrigerant, a condenser 3 configured to condense the refrigerant flowing out from the compressor, an expansion mechanism 4 configured to adiabatically expand the refrigerant flowing out from the condenser 3, an evaporator 5 configured to evaporate the refrigerant flowing out from the expansion mechanism 4, and a refrigerant pipe 2 sequentially connecting the compressor 1, the condenser 3, the expansion mechanism 4, and the evaporator 5 to circulate the refrigerant. Note that, as necessary, the refrigerant pipe 2 may be optionally provided with, for example, a switching valve configured to change the flow direction of the refrigerant (for example, a four-way valve), or an air-sending device configured to blow air to the condenser 3 or the evaporator 5.

(Compressor)

In FIG. 2, to smoothly rotate a compression mechanism 9, an oil reservoir 8 for storing a machine oil (hereafter referred to as "refrigerating machine oil") is provided in the bottom portion of a sealed container 10.

The compressor 1 includes the sealed container 10 and, in the sealed container 10, the compression mechanism 9 and an electric motor 6 configured to rotatively drive the compression mechanism 9. The refrigerating machine oil is supplied to a slidable section of the compression mechanism 9. The high-pressure and high-temperature refrigerant due to compression by the compression mechanism 9 is once discharged together with the refrigerating machine oil into the sealed container 10. Thus, the electric motor 6 is exposed to such high-pressure and high-temperature refrigerant and refrigerating machine oil.

(Compression Mechanism)

The compression mechanism 9 includes a main bearing (upper bearing) 9*m* and an auxiliary bearing (lower bearing) 9*s*, a sealed space formed by these bearings and a cylinder 9*c* both end surfaces of which are closely in contact with the bearings (to be exact, an inflow port through which the refrigerant flows in and an outflow port through which the refrigerant flows out are formed), and an eccentric cylinder 9*e* disposed in the sealed space.

The eccentric cylinder 9*e* is fixed to a driving shaft 9*a*. The driving shaft 9*a* is rotatably supported by the main bearing 9*m* and the auxiliary bearing 9*s*. Thus, rotation of the driving shaft 9*a* causes the eccentric cylinder 9*e* to eccentrically rotate.

In addition, plural vanes 9*b* movable forward and backward are disposed in plural grooves (not shown) formed radially in the cylinder 9*c*, so as to be pressed to the outer peripheral surface of the eccentric cylinder 9*e*. In other words, plural spaces are each formed between a pair of vanes; each volume of the spaces varies with rotation of the eccentric cylinder 9*e*, so that compression chambers are formed.

(Electric Motor)

The electric motor 6 includes a stator 6*s* fixed to the sealed container, and a rotor 6*r* surrounded by the stator 6*s* and configured to rotate. The driving shaft 9*a* forming the compression mechanism 9 is fixed to the rotor 6*r*.

The stator 6*s* has a cylindrical shape, and includes a back yoke part (not shown) forming an outer periphery of the stator 6*s*, plural teeth parts (not shown) protruding from the back yoke part toward the center, and a winding wire (electric wire) 6*w* wound around the teeth parts through intermediation of an insulating material 7 (insulator).

To supply electric power from the outside to the electric motor, a lead wire 11 is connected to the winding wire (electric wire) 6*w*, a resin cluster 12 is connected to a tip of the lead wire, and further connected to a glass terminal 13.

(Refrigerant)

The refrigerant is a single- or multi-component substance composed of at least one of difluoromethane (HFC-32) and ethylene-based hydrogen fluoride, or a multi-component substance containing a mixture of difluoromethane (HFC-32) and ethylene-based hydrogen fluoride. The ratio of the ethylene-based hydrogen fluoride to HFC-32 is 10 to 70 wt %.

The ethylene-based hydrogen fluoride may be any one of trans-1,2-difluoroethylene (R1132(E)), fluoroethylene (R1141), cis-1,2-difluoroethylene (R1132(Z)), 1,1-difluoroethylene (R1132a), and 1,1,2-trifluoroethylene (R1123), or one or more of the foregoing may be mixed.

(Refrigerating Machine Oil)

The refrigerating machine oil is stored in the oil reservoir 8 of the sealed container 10. The refrigerating machine oil is at least one of an ester-based oil, an ether-based oil, a glycol-based oil, an alkylbenzene-based oil, a poly-α-olefin-based oil, a polyvinyl ether-based oil, a fluorine-based oil, a naphthene-based mineral oil, and a paraffin-based mineral oil. In other words, the refrigerating machine oil is a single-component substance composed of any one of the foregoing or a multi-component substance composed of two or more of the foregoing.

(Insulating Material)

The insulating material 7 is formed of "LCP". LCP is a general term for polymers that exhibit properties of liquid crystal when being melted. There are plural molecular structures that belong to LCP, and the heat resistance and the strength vary depending on constitutional monomers.

The LCP forming the insulating material 7 is a thermoplastic resin prepared by copolymerization (polycondensation) of two or more monomer components in total that are p-hydroxybenzoic acid (PHB) as an essential monomer and at least one additive component selected from those described below.

The additive component is at least one of the following five components:

4,4'-biphenol (BP),
hydroquinone (HQ),
terephthalic acid (TPA),
isophthalic acid (IPA), and
6-hydroxy-2-naphthoic acid (BON6).

For example, the insulating material 7 is composed of "LCP-A", which is based on two components of PHB and BON6, or "LCP-B", which is prepared by polycondensation of six monomer components (PHB, BP, HQ, TPA, IPA, and BON6) including the essential component and all the additive components.

TABLE 1

| Type of resin | LCP raw material monomer | | | | | | Water absorption rate | Latent heat of crystallization |
|---|---|---|---|---|---|---|---|---|
| | PHB | BP | BON6 | HQ | TPA | IPA | | |
| LCP-A | + | − | + | − | − | − | 0.01% | 3 J/g |
| LCP-B | + | + | + | + | + | + | 0.01% | 3 J/g |
| PBT | − | − | − | − | − | − | 0.10% | 30 J/g |

In Table 1, compared with PBT alone (polybutylene terephthalate), LCP-A and LCP-B have small values in terms of absorption rate and latent heat of crystallization. Thus, LCP-A and LCP-B have high heat resistance and high extractability, have low melt viscosity during molding and high fluidity even in narrow spaces, and shift from the molten state to solidification with a low heat transfer so that the solidification rate is very high and burrs tend not to be formed during a production step.

In addition, LCP-A and LCP-B have a latent heat of crystallization of 10 J/g or less, measured by a differential scanning calorimeter (DSC). Thus, LCP-A and LCP-B have a high solidification rate and burrs tend not to be formed during the production step. Accordingly, LCP-A and LCP-B can be subjected to high-cycle molding and processed at high productivity.

Specifically, LCP has ester bonds and hence the molecular structure undergoes hydrolysis; however, LCP is not in a state in which molecules are tangled in a rubber form as in an ordinary resin but a liquid crystal resin in a state in which stiff molecules are linearly oriented densely. Thus, LCP has very low water absorption rate. Engineering plastics such as PBT have a water absorption rate of "0.1%", whereas LCP has a water absorption rate of "0.01% (after immersion in water at 23 degrees C. for 24 hours)", which is a value smaller by a digit or more than that of engineering plastics.

Accordingly, LCP forming the insulating material 7 has high heat resistance, high chemical resistance, and high extractability, so that LCP has high stability against any of the above-described refrigerating machine oils and refrigerants.

Figure 3:
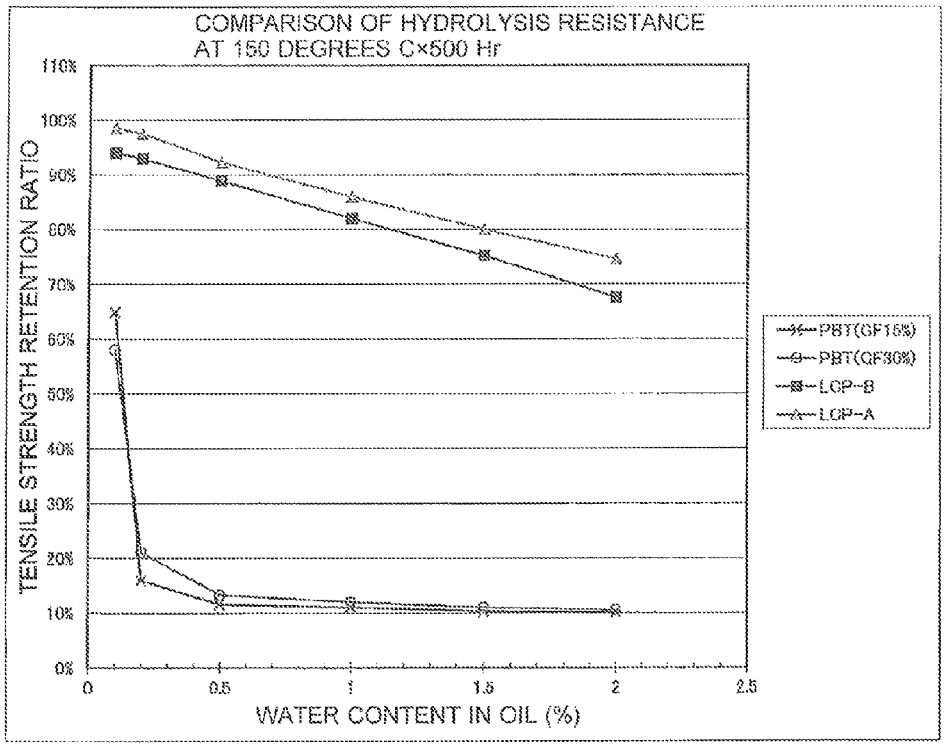
FIG. 3 is a characteristic graph indicating the hydrolysis resistance of a part (heat insulator) of the heat pump apparatus illustrated in FIG. 1.

FIG. 3 is a characteristic graph indicating hydrolysis resistance of a part (insulating material) of a heat pump apparatus according to Embodiment 1 of the present invention.

In FIG. 3, the vertical axis indicates tensile strength retention ratio (ratio of strength after a test with respect to the initial strength), and the horizontal axis indicates the water content in oil of the refrigerating machine oil.

The tensile strength retention ratio is measured for cases in which the refrigerating machine oil is an ether oil having high hygroscopicity, the refrigerant is R32 refrigerant, and LCP-A, LCP-B, and PBTs for comparison are immersed in a container containing the ether oil and the R32 refrigerant at 150 degrees C. for 500 hours.

In general, insulating materials are required to have a tensile strength retention ratio of about 50% on the basis of, for example, tests for a practical use using an actual compressor; and insulating materials are required to have a longevity of about 20,000 hours according to standards such as UL and Electrical Appliance and Material Safety Law. This longevity is similar to the estimated total operation time for the replacement cycle (10 years) of air-conditioning apparatus.

It is known that an increase in the temperature accelerates chemical deterioration of material. It is considered that an increase of 10 degrees C. approximately doubles the degree of deterioration of properties such as strength (the rule of double rate for every 10 degrees C. rise). A compressor used in an air-conditioning apparatus has a maximum internal temperature of about 70 degrees C. during steady operation. When the test temperature is 150 degrees C., the difference from the maximum internal temperature is 80 degrees C. According to the rule of double rate for every 10 degrees C. rise, the acceleration factor is 256.

Compared with R410A refrigerant, a temperature of R32 refrigerant increases by 10 degrees C. to 20 degrees C. Thus, the maximum internal temperature reaches about 90 degrees C. Even in this case, the acceleration factor is 64, and 64×500 hours=32,000 equivalent hours. This is sufficient evaluation time in consideration of the required longevity of an air-conditioning apparatus.

Here, as is clear from FIG. 3, regarding PBTs as the comparative materials, even when the water content in oil is 0.1%, the tensile strength retention ratio is only about 60%; in addition, when the water content in oil reaches 0.2%, the tensile strength retention ratio sharply drops; and when the water content in oil is 0.5% or more, the tensile strength retention ratio is as low as 10%.

On the other hand, regarding each of LCP-A and LCP-B according to the embodiment of the present invention, as the water content in oil increases, the tensile strength retention ratio decreases; however, when the water content is in the range of 2% or less, a tensile strength retention ratio of 70% or more is ensured.

Thus, when the refrigerating machine oil has a water content of 2% or less, LCP-A and LCP-B according to the embodiment of the present invention sufficiently retain their insulating function. Therefore, a highly reliable electric motor 6 and a highly reliable heat pump apparatus 100 can be provided.

As described above, two-component LCP-A and six-component LCP-B exhibit similar hydrolysis resistance. Accordingly, as long as PHB is contained, similar hydrolysis resistance is also provided in three-component monomers of any combinations and in four- or five-component monomers of any combinations.

Note that, LCP is a resin that exhibits, in the molten state, the intermediate phase between solid and liquid; in other words, a large number of rod-shaped molecules are arranged and solidification occurs without substantial changes from the state at the time of melting. Specifically, LPC in the molten state is subjected to a shear force applied by injection or extrusion, so that the molecules are more densely oriented, to thereby prevent entry and permeation of water molecules into gaps between the molecules. This is the reason why LPC is excellent in terms of hydrolysis resistance.

Accordingly, LCP is, due to this structure, highly advantageous in terms of hydrolysis resistance, compared with normal resins having ester bonds, such as PET and PBT. Chemical substances other than water also tend not to permeate LCP and hence LCP has very high chemical resistance.

In addition, the six monomer components themselves all have an aromatic ring and are molecules having a stiff skeleton. The LCP is a wholly aromatic LCP constituted by such monomers, so that the LCP further resists hydrolysis and has high chemical resistance.

Embodiment 2

Figure 4:
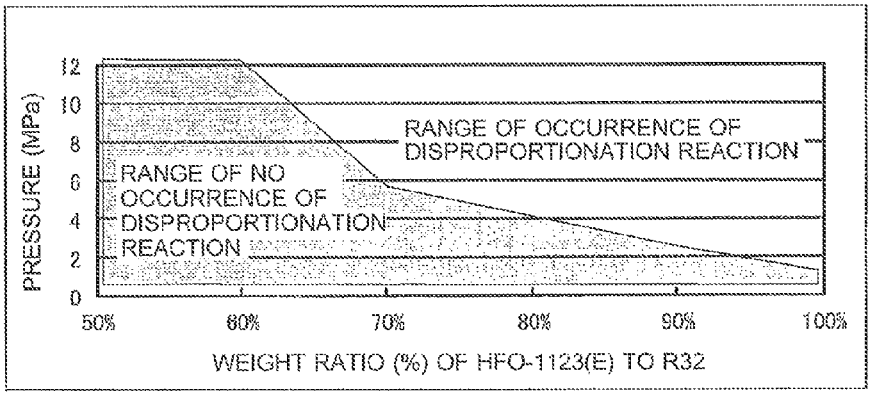
FIG. 4 is a pressure-weight ratio correlation diagram of a heat pump apparatus according to Embodiment 2 of the present invention, the diagram indicating the range in which disproportionation reaction occurs when ethylene-based hydrogen fluoride refrigerant, trans-1,1,2-trifluoroethylene (R1123(E)), is mixed with R32 at 250 degrees C. at different mixing ratios and pressures.

FIG. 4 is a pressure-weight ratio correlation diagram of a heat pump apparatus according to Embodiment 2 of the present invention, the diagram indicating the range where disproportionation reaction occurs when ethylene-based hydrogen fluoride refrigerant, trans-1,1,2-trifluoroethylene (R1123(E)), is mixed with R32 at 250 degrees C. at different mixing ratios and pressures. The heat pump apparatus according to Embodiment 2 of the present invention has the same configuration as in Embodiment 1 in terms of the refrigerant circuit, the compressor, the electric motor, and the refrigerating machine oil except for the refrigerant.

FIG. 4 indicates that, as the mixing ratio of R1123(E) increases and as the pressure increases, disproportionation reaction tends to occur.

In the heat pump apparatus of Embodiment 2, the refrigerant pressure is 6 MPa at the maximum. Within the usage pressure range, the ratio of the ethylene-based hydrogen fluoride refrigerant (1,1,2-trifluoroethylene (R1123(E))) is set to 70 wt % or less, so that disproportionation reaction does not occur and damaging of the refrigeration cycle and the refrigerant compressor is prevented. In addition, even when the compressor discharge temperature increases due to R32 refrigerant, as long as the refrigerating machine oil has a saturated water content of 2% or less, the insulating material is not hydrolyzed and sufficiently retains its insulating function. Thus, a highly reliable electric motor 6 and a highly reliable heat pump apparatus 100 can be provided.

In the above description, the example of using trans-1,2-difluoroethylene (R1132(E)) as ethylene-based hydrogen fluoride refrigerant is described. However, similar advantages can also be provided by using any one of fluoroethylene (R1141), cis-1,2-difluoroethylene (R1132(Z)), 1,1-difluoroethylene (R1132a), and 1,1,2-trifluoroethylene (R1123), or by mixing one or more of the foregoing.

Embodiment 3

The refrigerant used in Embodiment 3 is a single- or multi-component substance composed of at least one of propylene-based fluorohydrocarbon (HFO-1234yf) and ethylene-based hydrogen fluoride, or a multi-component substance containing a mixture of difluoromethane (HFC-32) and ethylene-based hydrogen fluoride. The ratio of the ethylene-based hydrogen fluoride to R32 is 70 wt % or less.

The ethylene-based hydrogen fluoride may be any one of trans-1,2-difluoroethylene (R1132(E)), fluoroethylene (R1141), cis-1,2-difluoroethylene (R1132(Z)), 1,1-difluoroethylene (R1132a), and 1,1,2-trifluoroethylene (R1123), or one or more of the foregoing may be mixed.

Propylene-based fluorohydrocarbon or ethylene-based hydrogen fluoride refrigerants are thermally and chemically unstable and tend to undergo decomposition or polymerization through chemical reaction. In particular, in high-temperature areas, the chemical reaction of refrigerant is accelerated and the decomposition reaction tends to occur. For this reason, to suppress the decomposition reaction of refrigerant, for example, a step such as making a flame retardant adhere to high-temperature areas is necessary.

In the compressor, as described above, the slidable section of the compression element and the winding wire portion of the electric element have high temperature. In the slidable section of the compression element, parts constituting the compression element slide against each other to generate heat. In the winding wire portion of the electric element, current is passed through the winding wire to rotate the rotor **6*r***, which results in generation of heat.

Ethylene-based fluorohydrocarbon has high reactivity and hence, even under storage at ordinary temperature, undergoes decomposition or polymerization. For this reason, when ethylene-based fluorohydrocarbon is used as refrigerant, a polymerization inhibitor for suppressing polymerization of the refrigerant is added at the time of generation of the refrigerant; and, for example, even during storage, the ethylene-based fluorohydrocarbon is always mixed with a polymerization inhibitor. The ethylene-based fluorohydrocarbon is not used or stored in the state of being separated from the polymerization inhibitor. However, in the compressor, sliding between metals causes decomposition of the refrigerant to proceed and the decomposition products have a high probability of polymerization. Even when the polymerization inhibitor is added to the refrigerant, in the slidable section of the compression element and the winding wire portion of the electric element at high temperature, the refrigerant vaporizes, and the polymerization inhibitor is carried away together with the vaporized refrigerant. Thus, the polymerization inhibitor does not remain in the slidable section of the compression element or the winding wire portion of the electric element at high temperature, so that the polymerization inhibitor does not sufficiently exert its effect. Accordingly, an explosive decomposition reaction may be initiated by, for example, generated heat by polymerization of the refrigerant, which may result in damaging of the refrigeration cycle and the refrigerant compressor.

When the refrigerating machine oil contains tetrabromobisphenol A (TBBA), even in the case of generation of active radicals initiating the decomposition reaction due to, for example, high temperature, the radicals are effectively deactivated to effectively suppress the decomposition reaction.

In this way, the refrigerating machine oil containing tetrabromobisphenol A (TBBA) prevents the decomposition reaction that tends to occur in high-temperature areas. Accordingly, even when a refrigerant that tends to undergo decomposition reaction is used, sufficient reliability can be maintained.

In the above description, the example of using trans-1,2-difluoroethylene (R1132(E)) as the ethylene-based hydrogen fluoride refrigerant is described. Similar advantages are also provided by using, for example, fluoroethylene (R1141), cis-1,2-difluoroethylene (R1132(Z)), 1,1-difluoroethylene (R1132a), or 1,1,2-trifluoroethylene (R1123).

In the above description, tetrabromobisphenol A (TBBA) is used as the flame retardant contained in the refrigerating machine oil. The flame retardant may be a halogen-based flame retardant such as TBBA carbonate oligomer, TBBA epoxy oligomer, decabromodiphenyl ether, hexabromocyclododecane, bis(pentabromophenyl)ethane, bis(tetrabromophthalimide)ethane, brominated polystyrene, Dechlorane, chlorendic acid, or chlorendic anhydride.

Alternatively, the flame retardant may be a phosphorus-based flame retardant such as triphenyl phosphate, tricresyl phosphate, trixylyl phosphate, 1,3-phenylene bis(diphenyl phosphate), 1,3-phenylene-bis(dixylenyl phosphate), bisphenol A-bis(diphenyl phosphate), tris(dichloropropyl) phosphate, tris(β-chloropropyl) phosphate, 2,2-bis(chloromethyl) trimethylenebis(bis(2-chloroethyl) phosphate), or red phosphorus.

Embodiment 4

In Embodiment 3, the described method of preventing the decomposition reaction of refrigerant is to make a sufficient amount of refrigerating machine oil containing a flame retardant be present in high-temperature areas. A slidable part can be made to contain a flame retardant in advance. This method will be described.

In Embodiment 4, slidable parts constituting the compressing mechanism that are the cylinder 9*c*, the driving shaft 9*a*, the vanes 9*b*, the main bearing 9*m*, and the sub-bearing 9*s* can be porous sintered or cast iron parts. These slidable parts are impregnated with a flame retardant or a refrigerating machine oil containing a flame retardant in advance and the compressor is assembled. Thus, the flame retardant seeps out from the compressor slidable parts that tend to have high temperature, to thereby further enhance the effect of suppressing the decomposition reaction of refrigerant.

In this way, even when the refrigerating machine oil is not sufficiently present in the slidable section of the compression element and the decomposition conditions of the refrigerant are satisfied, the retained flame retardant enables suppression of the decomposition reaction of the refrigerant.

In addition, in this case, the slidable parts can be made to contain an antimony compound such as antimony trioxide or antimony pentoxide, to thereby enhance the effect of the halogen-based flame retardant described in Embodiment 3.

Embodiment 5

The winding wire portion of the electric element, the insulating material 7 in contact with the winding wire, the coating resin of the lead wire 11, and the cluster 12, which are not in the slidable section but tend to have high temperature, can also be made to contain a flame retardant in advance as in Embodiment 4. This method will be described below as Embodiment 5.

In a winding wire portion 12*b* of the electric element, use of a winding wire having a circular cross section results in formation of gaps between the wound wires. As with the pores of the slidable parts, such gaps between wound wires can be used to contain and retain a flame retardant or a refrigerating machine oil containing a flame retardant. For example, a flame retardant may be contained in a coating oil that is applied to the surface of the winding wire to impart surface smoothness to enhance workability of the winding wire, or the winding wire may be immersed in a flame retardant. Thus, the flame retardant in the winding wire 6*w* is sufficiently supplied to the winding wire portion in which the decomposition reaction occurs, to thereby enhance the effect of suppressing the decomposition reaction of the refrigerant.

In this way, even when the refrigerating machine oil is not sufficiently present in the winding wire portion of the electric element and the decomposition conditions of refrigerant are satisfied, the retained flame retardant enables suppression of the decomposition reaction of refrigerant.

Regarding the insulating material 7, the coating resin of the lead wire 11, and the cluster 12, advantages similar to the above are also provided by mixing a flame retardant, for example, during a compounding step for producing the resin.

Embodiment 6

The refrigerating machine oil used in Embodiments 1 to 5 above usually contains an anti-wear agent. The anti-wear agent itself decomposes to thereby prevent wear of slidable parts. It is known that the decomposition product of the anti-wear agent reacts with the decomposition product of ethylene-based fluorohydrocarbon that tends to undergo polymerization or decomposition or a mixture containing the ethylene-based fluorohydrocarbon, to thereby form a solid substance. This solid substance accumulates in small-diameter channels such as the expansion valve and a capillary tube in the refrigeration cycle and clogs them. This may result in poor cooling.

In Embodiment 6, a refrigerating machine oil not containing anti-wear agents is appropriately selected. Thus, the solid substance is not generated through reaction between the decomposition product of an anti-wear agent and the decomposition product of ethylene-based fluorohydrocarbon and a mixture of ethylene-based fluorohydrocarbon. Accordingly, a refrigerant compressor can be obtained in which the refrigeration cycle is not clogged and high performance can be maintained for a long time.

The invention claimed is:

1. A heat pump apparatus comprising:

a compressor;

a condenser;

an expansion mechanism; and an evaporator, the compressor, the condenser, the expansion mechanism, and the evaporator being configured to perform a refrigeration cycle, the heat pump apparatus being configured to perform heat transfer in the condenser or the evaporator, the compressor including a sealed container, a compression mechanism mounted inside the sealed container, and an electric motor configured to rotatively drive the compression mechanism, the compression mechanism being configured to compress a refrigerant, and to be lubricated by a refrigerating machine oil, the electric motor including a stator fixed to the sealed container, with a winding wire being wound around the stator through intermediation of an insulating material, and a rotor surrounded by the stator, wherein the insulating material comprises a wholly aromatic liquid crystal polyester (LCP) having a molecular main chain constituted by a monomer including p-hydroxybenzoic acid (PHB) as an essential monomer and a monomer solely including benzene-ring as another monomer via an ester bond, and wherein the refrigerant comprises any one of a single-component substance composed of difluoromethane (HFC-32), propylene-based fluorohydrocarbon (HFO-1234yf), or ethylene-based hydrogen fluoride; a multi-component substance composed of two or more of difluoromethane (HFC-32), propylene-based fluorohydrocarbon (HFO-1234yf), and ethylene-based hydrogen fluoride; and a multi-component substance containing a mixture of difluoromethane (HFC-32) and ethylene-based hydrogen fluoride, and a ratio of the ethylene-based hydrogen fluoride to the difluoromethane (HFC-32) is less than 60 wt %.

2. The heat pump apparatus of claim 1, wherein the wholly aromatic liquid crystal polyester (LCP) as the insulating material has a latent heat of crystallization of 10 J/g or less measured by a differential scanning calorimeter (DSC).

3. The heat pump apparatus of claim 1, wherein the insulating material comprises a wholly aromatic liquid crystal polyester (LCP) synthesized by polycondensation of two or more monomers in total that are p-hydroxybenzoic acid (PHB) as an essential monomer component having an ester bond, and at least one additive component selected from five components of 4,4'-biphenol (BP), hydroquinone (HQ), terephthalic acid (TPA), isophthalic acid (IPA), and 6-hydroxy-2-naphthoic acid (BONG).

4. The heat pump apparatus of claim 1, wherein the refrigerating machine oil comprises a single-component substance or a multi-component substance composed of at least one of an ester-based oil, an ether-based oil, a glycol-based oil, an alkylbenzene-based oil, a poly-α-olefin-based oil, a polyvinyl ether-based oil, a fluorine-based oil, a naphthene-based mineral oil, and a paraffin-based mineral oil.

5. The heat pump apparatus of claim 1, wherein the ethylene-based hydrogen fluoride comprises a single-component substance or a multi-component substance composed of at least one of trans-1,2-difluoroethylene (R1132(E)), fluoroethylene (R1141), cis-1,2-difluoroethylene (R1132(Z)), 1,1-difluoroethylene (R1132a), and 1,1,2-trifluoroethylene (R1123).

6. The heat pump apparatus of claim 1, wherein a flame retardant that inhibits a decomposition reaction of the refrigerant is contained in at least one of the refrigerating machine oil, a slidable part of the compressor, the insulating material, a surface-coating oil of the winding wire, a coating of a lead wire connected to the winding wire, and a cluster connected to the lead wire.

7. The heat pump apparatus of claim 6, wherein the flame retardant comprises at least one of a halogen-based flame retardant, a phosphorus-based flame retardant, and an antimony compound.

8. The heat pump apparatus of claim 1, wherein the refrigerating machine oil has a saturated water content of 0.2% or less.

9. A heat pump apparatus comprising:

a compressor;

a condenser;

an expansion mechanism; and an evaporator, the compressor, the condenser, the expansion mechanism, and the evaporator being configured to perform a refrigeration cycle, the heat pump apparatus being configured to perform heat transfer in the condenser or the evaporator, the compressor including a sealed container, a compression mechanism mounted inside the sealed container, and an electric motor configured to rotatively drive the compression mechanism, the compression mechanism being configured to compress a refrigerant, and to be lubricated by a refrigerating machine oil, the electric motor including a stator fixed to the sealed container, with a winding wire being wound around the stator through intermediation of an insulating material, and a rotor surrounded by the stator, wherein the insulating material comprises a wholly aromatic liquid crystal polyester (LCP) synthesized by polycondensation of two or more monomers in total that are p-hydroxybenzoic acid (PHB) as an essential monomer, and at least two additive components selected from five components of 4,4'-biphenol (BP), hydroquinone (HQ), terephthalic acid (TPA), isophthalic acid (IPA), and 6-hydroxy-2-naphthoic acid (BONG) or at least one additive component selected from three components of hydroquinone (HQ), terephthalic acid (TPA), isophthalic acid (IPA), and wherein the refrigerating machine oil has a saturated water content of 2% or less at 40 degrees C. and a relative humidity of 80%, for 24 Hr.

10. The heat pump apparatus of claim 9, wherein the refrigerating machine oil comprises a single-component substance or a multi-component substance composed of at least one of an ester-based oil, an ether-based oil, a glycol-based oil, an alkylbenzene-based oil, a poly-α-olefin-based oil, a polyvinyl ether-based oil, a fluorine-based oil, a naphthene-based mineral oil, and a paraffin-based mineral oil.

11. The heat pump apparatus of claim 9, wherein the refrigerant comprises any one of a single-component substance composed of difluoromethane (HFC-32), propylene-based fluorohydrocarbon (HFO-1234yf), or ethylene-based hydrogen fluoride; a multi-component substance composed of two or more of difluoromethane (HFC-32), propylene-based fluorohydrocarbon (HFO-1234yf), and ethylene-based hydrogen fluoride; and a multi-component substance containing a mixture of difluoromethane (HFC-32) and ethylene-based hydrogen fluoride, and a ratio of the ethylene-based hydrogen fluoride to the difluoromethane (HFC-32) is less than 60 wt %.

12. The heat pump apparatus of claim 9, wherein the ethylene-based hydrogen fluoride comprises a single-component substance or a multi-component substance composed of at least one of trans-1,2-difluoroethylene (R1132(E)), fluoroethylene (R1141), cis-1,2-difluoroethylene (R1132(Z)), 1,1-difluoroethylene (R1132a), and 1,1,2-trifluoroethylene (R1123).

13. The heat pump apparatus of claim 1, wherein a flame retardant that inhibits a decomposition reaction of the refrigerant is contained in at least one of the refrigerating machine oil, a slidable part of the compressor, the insulating material, a surface-coating oil of the winding wire, a coating of a lead wire connected to the winding wire, and a cluster connected to the lead wire.

14. The heat pump apparatus of claim 13, wherein the flame retardant comprises at least one of a halogen-based flame retardant, a phosphorus-based flame retardant, and an antimony compound.

15. The heat pump apparatus of claim 9, wherein the refrigerating machine oil has a saturated water content of 0.2% or less.

* * * * *